US006345864B1

(12) United States Patent
Rivera et al.

(10) Patent No.: US 6,345,864 B1
(45) Date of Patent: Feb. 12, 2002

(54) ADJUSTABLE SUPPORT AND RETENTION DEVICE FOR INTERCHANGEABLE FURNISHINGS AND/OR EQUIPMENT

(76) Inventors: Gloria Ramos Rivera, 206 Larry Dr., DeSoto, TX (US) 75115; Roberta Lee Baird, 5335 Bent Tree Forest, #226, Dallas, TX (US) 75248

( * ) Notice: Subject to any disclaimer, the term of this patent is extended or adjusted under 35 U.S.C. 154(b) by 0 days.

(21) Appl. No.: 09/393,102

(22) Filed: Sep. 9, 1999

(51) Int. Cl.[7] ..... A47C 13/00
(52) U.S. Cl. ..... 297/130; 297/134; 297/244
(58) Field of Search ..... 297/129, 130, 297/134, 344.18, 344.19, 244, 344.1; 248/177.1, 678, 688

(56) References Cited

U.S. PATENT DOCUMENTS

| | | | | | |
|---|---|---|---|---|---|
| 965,932 | A | * | 8/1910 | Pfeiffer | 297/134 X |
| 2,516,774 | A | * | 7/1950 | Gottfried | 297/134 |
| 2,658,554 | A | * | 11/1953 | Specter et al. | 297/134 |
| 2,667,207 | A | * | 1/1954 | Magyar | 297/134 |
| 3,528,096 | A | * | 9/1970 | Moberg | 297/130 |
| 3,891,270 | A | * | 6/1975 | Crossman | 297/344.19 |
| 5,040,265 | A | | 8/1991 | France et al. | 16/35 |
| 5,203,581 | A | | 4/1993 | Jankowski | 280/87.051 |
| 5,234,187 | A | | 8/1993 | Teppo et al. | 248/161 |
| 5,238,292 | A | | 8/1993 | Golenz et al. | 297/153 |
| 5,364,137 | A | | 11/1994 | Shimer | 297/327 |
| 5,402,864 | A | | 4/1995 | Block et al. | 188/19 |
| 5,468,051 | A | | 11/1995 | Huang | 297/344.18 |
| 5,582,462 | A | | 12/1996 | Shea | 297/467 |
| 5,676,386 | A | | 10/1997 | Huang | 280/30 |
| 5,707,104 | A | | 1/1998 | Perego | 297/16.1 |
| 5,765,804 | A | | 6/1998 | Stumpf et al. | 248/631 |
| D402,235 | S | | 12/1998 | Haut | D12/129 |
| 5,893,606 | A | | 4/1999 | Chiang | 297/118 |
| 5,904,400 | A | | 5/1999 | Wei | 297/353 |
| 5,944,384 | A | | 8/1999 | Patterson | 297/344.23 |
| 5,992,805 | A | * | 11/1999 | Tanner | 248/177.1 X |

* cited by examiner

*Primary Examiner*—Peter R. Brown
(74) *Attorney, Agent, or Firm*—Ortiz & Lopez, PLLC; Luis M. Ortiz; Kermit D. Lopez

(57) ABSTRACT

An adjustable support and retention device for supporting and retaining interchageable furnishing and/or equipment is disclosed. The invention includes a pedestal; a horizontally adjustable support column attached to the pedestal for providing rotatable support to a support and retention assembly; and a support and retention mechanism. The support column assembly is attached to and projects upwards from the pedestal and provides verticle and horizontal adjustment. The pedestal can be comprised of five support members extending outwardly from its center and can include rollers for providing ground mobility to the pedestal. A braking mechanism may be provided for the rollers or pedestal to prevent movement of the pedestal with respect to the ground. Interchangeable furnishing (e.g., car seats and/or high chairs) are adaptable for use with the support and retention mechanism through complimentary hardware. At least one child seat is securably connectable to and supportable by the adjustable support and retention device of the present invention.

13 Claims, 2 Drawing Sheets

ADJUSTABLE SUPPORT AND RETENTION DEVICE FOR INTERCHANGEABLE FURNISHINGS AND/OR EQUIPMENT

FIELD OF THE INVENTION

The present invention relates to furnishings and equipment and, more particularly, to a multi-purpose adjustable support and retention device for interchangeably supporting and retaining furnishings and/or equipment.

BACKGROUND OF THE INVENTION

Child-related furniture and equipment include, but are limited to, high chairs, changing tables, bathing tubs, bassinets, cribs, and strollers. Several considerations must be taken by parents and caregivers regarding furnishings and equipment to include quality, price, convenience (space and use) and safety. Unfortunately, so many items are typically required to provide care to a child. Many times price or space dictates the type or quantity of equipment and furnishings acquired. For example, inhabitants of close quarters may not have the room for several items of child furnishings. To complicate matters, the advent of child fertility pills has spawned multiple births to many parents, causing a need for redundant furnishings.

It would be desirable to minimize the number of furnishings required for small households, households with several young children, and child care facilities. Such a need could be addressed with the provision of multifunctional furnishings that provide several functions. An example of such a furnishing is a car safety seat that can be held in a base strapped within a car, or to the car seat itself, and also a retaining mechanism adapted to a stroller. Such dual use or multifunctional technology allows parents to minimize the amount of equipment required during travel. Examples of other multifunctional child-related technology can be found in U.S. Pat. Nos. 5,676,386; D402,235; and 5,893,606.

It would also be desirable for safety and convenience to be a key feature of furniture and equipment design. For example, high chairs of varying designs are available. Many continue to have four legs as shown in U.S. Pat. Nos. 5,582,462 and 5,238,292. Such devices, however, are not regarded as stable and could topple. High chairs having four legs can be awkward because the legs stand out and are prone to be stumbled over or tripped on. Furthermore, the legs prevent a high chair from conveniently being relocated or adjusted for orientation around a dining room table. Several high chairs are collapsible as shown in U.S. Pat. Nos. 5,707,104 and 5,238,292, but not adjustable. Some have wheels to provide for some adjustability through the mobility provided by wheels as shown in U.S. Pat. Nos. 5,707,104 and 5,468,051. U.S. Pat. No. 5,468,051 to Huang provides vertical adjustability of the high chair through a pair of sleeves and struts and wheels for some ground mobility.

Unfortunately, many of the prior art devices are not easily adaptable to other uses. Furthermore, optimum safety and convenience is not readily achievable in the art. It would therefore be desirable to have a support and retention mechanism for plural child-related furnishings and equipment that takes into consideration convenience (e.g., adjustability and adaptability) and safety.

SUMMARY OF THE INVENTION

In order to overcome the shortcomings of the prior art there is provided an adjustable support and retention device for supporting and retaining interchangeable furnishings and/or equipment. The present invention fulfills a more specific need in the art of providing an adjustable support and retention device that is adaptable to plural child-related furnishings (e.g., furniture or equipment) that are adapted to interface with the invention. Interchangeable furnishing that are capable of being adapted for use in combination with the present invention, but in no way limited to the following, are chairs (e.g., car seats and/or high chairs), changing tables, table tops, bassinets, bathing tubs, and/or multi-purpose trays for other domestic uses (e.g., audio/visual equipment).

In accordance with the present invention there is provided a support and retention device including: a pedestal; a horizontally adjustable support column attached to the pedestal for providing rotatable support to an equipment support and retention mechanism; and a support and retention mechanism. The horizontally adjustable support column can be, for example, a telescoping-type support column assembly attached to and projecting upwards from the pedestal and for providing rotatable support to the support and retention assembly.

Another feature of the present invention provides a pedestal comprised of five support members (e.g., arms or legs) extending outwardly from the center of the pedestal, the members being integrated in the center and together forming the entire pedestal. The center portion of the pedestal provides support for the horizontally adjustable support column and adaptable equipment. The five members provide enhanced stability to the entire apparatus. Toppling is less likely with a five member configuration that extend to form a wide base.

Another feature of the present invention provides for a pedestal having five rollers (e.g., casters, wheels and the like) for providing support and ground mobility at the pedestal. Each roller would be retained by five support members extending outward from the center of the pedestal and forming the main body of the pedestal. The support members each rotatably retain one of the rollers. The pedestal also provides support for the telescoping column assembly. The pedestal may further comprise of a braking mechanism for preventing movement of said pedestal with respect to the ground.

Another feature of the present invention provides a braking mechanism for the pedestal in order to prevent or limit ground movement.

In accordance with another feature of the invention there is provided a child seat that is securably connectable to and supportable by the adjustable support and retention device of the present invention. The seat includes a back rest that is adjustably connected to the child seat (e.g., a cushioned seat bottom) for providing reclining of the backrest. Reclining of the backrest is important for feeding of smaller children and infants.

In accordance with another feature of the present invention there is provided a feeding tray assembly. The tray can be free-standing or adjustably attachable to the child seat.

Another feature of the present invention provides for a child seat assembly comprising of two child seats adjustably retained back-to-back on the support and retention device for providing two child seating capacity within a singular unit that is rotatably support by the support and retention mechanism. The two child seats would preferably be adjustable where the respective seats are secured/connected at the support and retention mechanism of the support and retention device. Adjustable seating may allow for adjustment of the angle (reclining angle) for each respective seats' seat back with respect to each other. The child seats may each be adaptable to adjustably retain feeding trays where use of an attached tray is desired.

Another feature of the present invention is the provision of a sliding or adjustable mechanism as part of the support and retention device for providing child seats horizontally adjustable with respect to each other thereby providing reclining operation to the seats and their respective seat backs. The mechanism may represent a track, that is adaptable to a complimentary track member of adaptable furniture or equipment, that can be provided as part of the support and retention mechanism.

A track member may be mounted to the bottom of chair assembly to provide for independent slidability of each seat of the dual seat assembly, thus allowing each seat to slide apart on the first track member thereby providing reclining action to each seat's respective back support.

There has thus been outlined, rather broadly, the more important features of the invention in order that the detailed description thereof that follows may be better understood, and in order that the present contribution to the art may be better appreciated.

There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF PREFERRED EMBODIMENTS OF THE INVENTION

Figure 1:
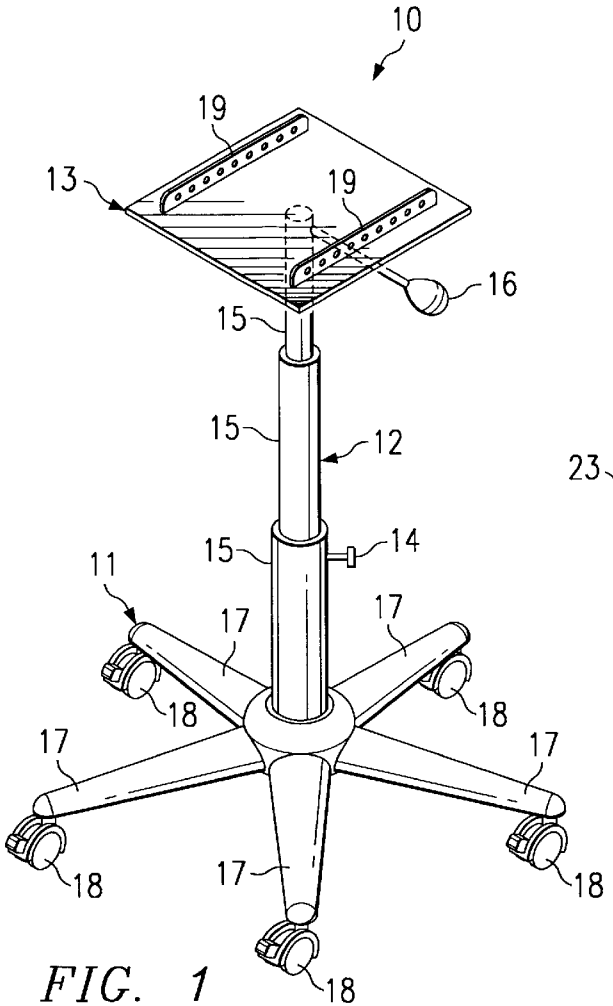
FIG. 1 is a one perspective view of an adjustable support and retention device of the present invention;.

Referring to FIG. 1, in accordance with a first embodiment of the present invention there is shown an adjustable support and retention device 10 for supporting and retaining interchangeable furnishings and equipment. The device includes a pedestal 11 which provides support for a horizontally adjustable support column 12, the pedestal and column further providing rotatable support to a furniture and/or equipment support and retention assembly 13. The horizontally adjustable support column 12 can be comprised of, for example, a telescoping type support column assembly (as shown). Telescoping, or otherwise vertically adjustable, support columns are generally available in the office furniture art and are typically operational through hydraulic and/or mechanical means. The support column 13 can provide rotational motion to the support and retention assembly 13 through its attachment to the pedestal 11 and/or the support and retention mechanism 13, and/or through any of the telescoping sections 15 of the column 12. It would be desirable to provide a locking mechanism 14 at the point of rotation (the column is shown providing rotation for exemplary purpose only). The locking mechanism can be, for example, provided in the form of a thumb-screw with an internal adjustable collar that slows or stops rotation of the tubular sections 15 or spring actuated detent pin or lever that must be actuated to release the rotating mechanism(s) in order to enable rotation of the support and retention mechanism 13. A lever 16 is also provided in an easily accessible place to provide for the vertical adjustment to the column 12. The lever 16 would actuate the vertical adjustment hardware located within the column's 12 tubular sections 15.

The pedestal 11 is preferably comprised of five support members 17 extending outwardly from the center of the pedestal. The members being integrated and forming the entire pedestal 11 upon which the support column 12 is supported. The pedestal 11 may also be comprised of a flat base of any geometric shape (e.g., round) wide enough to support the horizontal support column 12 support and retention assembly mechanism 13, and any furnishing or equipment (not shown) ultimately being supported by the pedestal 11. A four legged or three legged type pedestal 11 can be utilized but are discourage for their lack of providing lateral stability and safety. The pedestal 11 can provide additional stability and lateral support if additional weight is factored into the pedestal 11 area during design consideration. A mix of weight and design for the pedestal will therefore provide more stability to furniture or equipment being retained by the support and retention mechanism 13.

Figure 2:
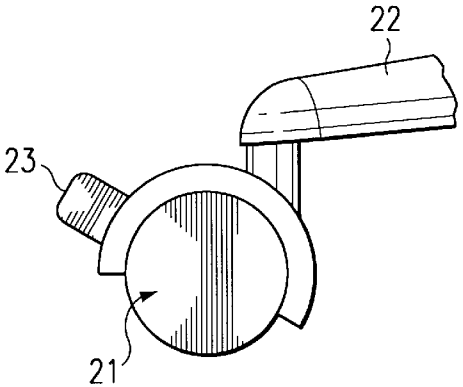
FIG. 2 is a front elevational view of a caster/roller assembly including a braking mechanism.

The pedestal also can include wheels or casters 18 for providing horizontal ground movement to the entire device and supported equipment or furnishing. Referring to FIG. 2, a caster 21 is shown at the end of a pedestal arm 22. The caster 21 extends outward from the arm 22 and also may include a locking mechanism 23 for preventing rotational movement of the caster 21 or wheel.

Figure 3:
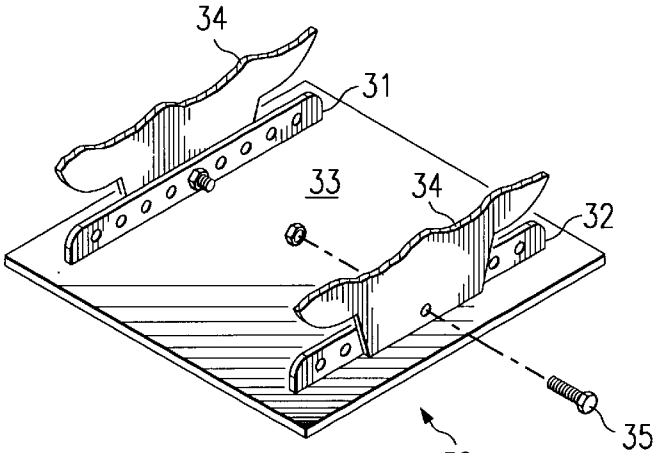
FIG. 3 is a blown up perspective view of an embodiment for a support and retention mechanism for the adjustable support and retention device of the present invention in FIG. 1.

Referring back to FIG. 1, the support and retention mechanism 13 is shown having two tracks 19 with holes or slots formed therein. Referring to FIG. 3, tracks 31 and 32 are fixed to a base 33. The tracks 31 and 32 are used to retain an object 34 and support it on the support and retention mechanism 30. The base 33 provides general support to the object 34, wherein the tracks retain the object by retaining pins 35, or the like, that are secured at the holes or slots. The holes or slots serve as mechanisms for receiving fastening items such as retaining pins 35, screws, latches, and the like, that secure an object 34 to the base.

The tracks are designed to preferably provide flexibility with regard to the position of the object 34 on the base 33. The dashed line object 34 is shown being fastened to the center of the support and retention mechanism 30. The device being retained must be slidably adaptable (matching the tracks and holes formed thereon) to the tracks 31 and 32. Retaining pins 35 can be integrated with the equipment being attached to the support and retention mechanism assembly 30. Such is the case with many tray tables for high chairs wherein a detent or pull pin (spring loaded pin) is formed at each side of the tray for holding the tray to the arms of the chair.

It should be appreciated that although the provision of two tracks 31 and 32 provides flexibility and security to objects being held to the base 33, a single track could be used to serve the same purpose. Furthermore, although multiple holes are shown on the tracks to provide for adjustability, it should be appreciated that the tracks, or single track may be designed to only provide for a single mounting and securing location that is positioned to provide a object 34 a balanced position upon the base 33. If such a configuration were provided, the track(s) would only have a single hole formed thereon for purposes of receiving a retaining pin 35.

Figure 4:
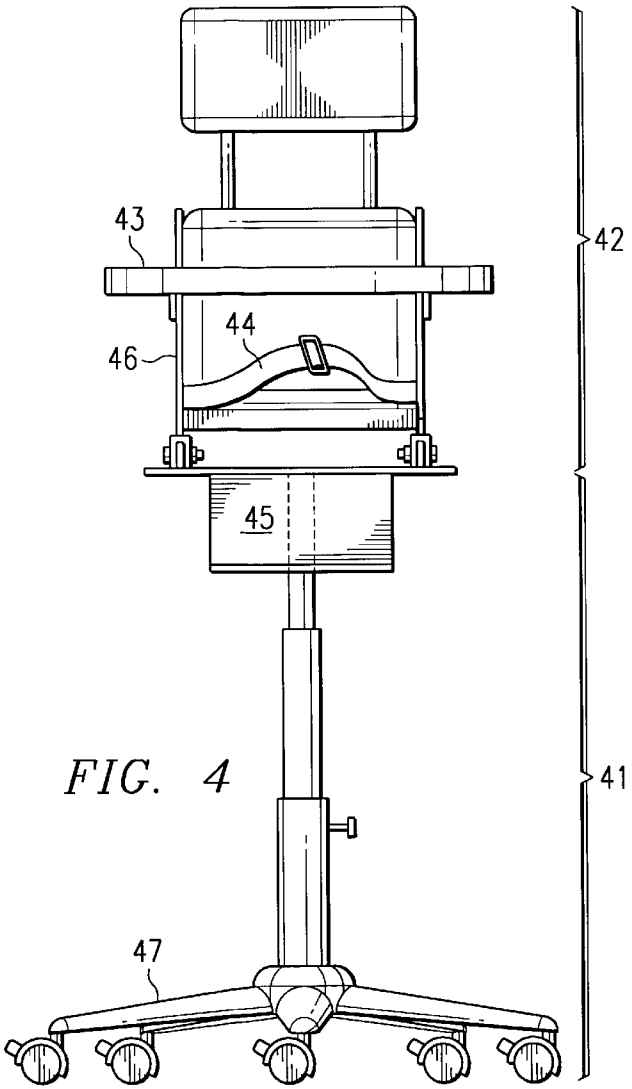
FIG. 4 is a front elevational view a high chair adaptable for use with the apparatus of FIG. 1.

Referring to FIG. 4, there is shown a child's chair 42 attached to the support and retention device 41 as described above. In this figure the chair 42 represents a high chair having a tray 43. Attached to the a chair 42 may be a safety belt or strap 44 to retain the child safely within the chair. A belt or strap can either be a shoulder harness or waist belt. The chair can also have a foot rest 45 that is attached to the chair 42. A foot rest 45 may be hinged so that it could be swung out of the way for storage purposes or the foot rest may be removable. A cover 47 may be provided at the pedestal to provide protection from pedestal hardware and to provide ease in maintaining cleanliness of the support and retention device 41. The cover may also provide additional weight to the device 41 in order to provide additional lateral support required for the chair and to provide tipping/toppling. The tray 43 preferably would preferably be a removable tray that is attachable to the arms 46 of the chair. A tray that can be used with a baby's chair as shown, or a free standing tray similar to a TV tray (not shown), could used with a child's chair not having an attachable tray 43. Removal of the tray would allow the chair to be height adjusted by the adjustable support and retention assembly 41 to fit under, near or by a conventional dining table (not shown).

Figure 5:
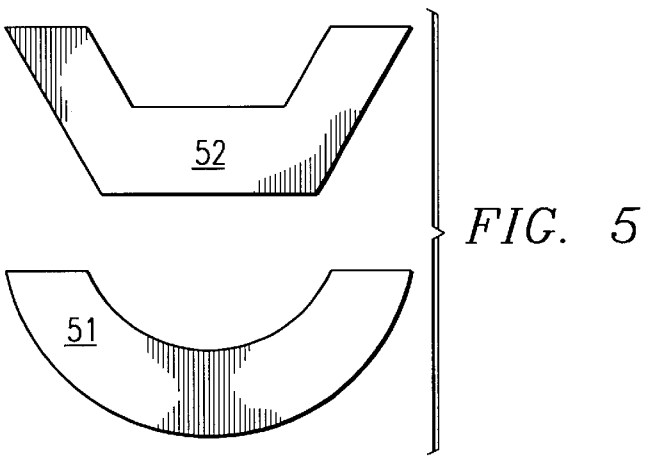
FIG. 5 is a top view of tray designs for use with the high chair of FIG. 4.

FIG. 5 shows design shapes for attachable trays that would work best with a high chair that has it rotationally, vertically and horizontally mobile as would be the case if a child's high chair were incorporated with the adjustable support and retention assembly of the present invention. A circular tray 51 or a tray that is angled 52 at the corners works well with a rotatable chair.

Figure 6:
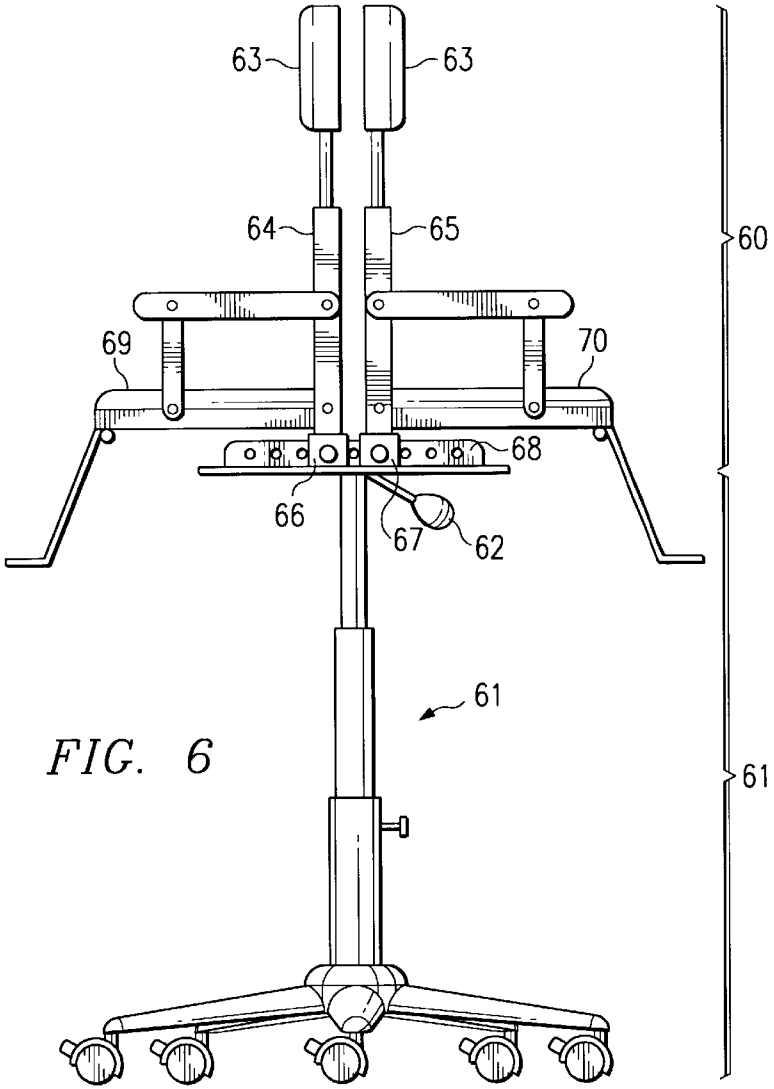
FIG. 6 is a side elevational view of a dual high chair adaptable for use with the apparatus of FIG. 1.

Referring to FIG. 6, shown is a back-to-back child's high chair 60 that can be adapted to be supported by the adjustable support and retention device 61 of the present invention. In the back-to-back high chair 60, multiple children can be seated and cared for at one time due to the flexibility of the adjustable support and retention device 61, which provides rotational adjustment for turning the chairs around (or back and forth) to accommodate the occupants of both seats during feeding and vertical (height) adjustment of the device 61 as controlled by a vertical adjustment lever 62.

Adjustable headrest 63 on each seat back 64 and 65 can be positioned for each occupants' head. Adjustable headrests 63 allow the height of each child's seat back to be adjusted in order to prevent heads from banging into each other. The headrest 63 can represent a portion of the seat back that is extendable in order to accommodate for a child's height.

Each seat would preferably have a separate sliding mechanism 66 and 67 that are each attachable to the tracks of the support and retention mechanism 68 (tracks 31 and 32 were described in FIG. 3). The separate sliding mechanisms 66 and 67 retain each seat to the support and retention mechanism 68 and allow each seat to individually adjust horizontally on the tracks, thereby providing reclining operation to the seats backs 64 and 65 as their respective seats 69 and 70 move apart from each other on the support and retention mechanism 68. Complimentary track members 66 and 67, for example, can be included on the bottom of each chair to provide for independent slidability of each seat on track(s) (31 and 32 shown in FIG. 3) if provided on the support and retention assembly 68, thus allowing each seat to slide apart on the support and retention mechanism 68. The track members/sliding mechanism 66 and 67 would have locking mechanisms, as described in FIG. 3, to retain the seats to the support and retention mechanism 68.

Currently, parents or child care facilities are required to have two high chairs in order to accommodate twins or multiple children at the same time. With the support and retention assembly 61 and an adaptable back to-back high chair 62, only one unit needs to be utilized during feeding. With such a configuration, a single tray can be utilized, such as a single freestanding tray. The dual chairs, or single chair of FIG. 4 are easily removable from the support and retention assembly for cleaning.

What is claimed is:

1. A multi-purpose adjustable device for supporting and retaining interchangeable furnishings, comprising:

a pedestal;

a telescoping support column assembly attached to and projecting upwards from the pedestal and providing rotatable support for an equipment retention assembly;

a retention mechanism supported by said telescoping support column assembly for supporting and retaining a detachable chair assembly, wherein said retention mechanism further comprises at least one track having at least one hole formed therein for accepting a locking means, said tracks for interfacing with complimentary track members and retention assemblies of said detachable chair assembly; and a detachable chair assembly, said chair assembly further comprising first and second child seats positioned in back-to-back configuration said first and second child seats further comprising and including first and second carriage assemblies horizontally slidable and retainable on said at least one track, wherein said first and second carriages are each assigned respectively to said first and second child seats allowing each of said first and second child seats to slide apart on said track and for retaining each of said first and second seat to said track.

2. The invention of claim 1 further comprising first and second feeding tray assemblies adjustably attachable to each of said first and second child seats.

3. The invention of claim 1 wherein said first and second child seats further comprise adjustable seat backs, wherein said seat backs are reclinable.

4. The invention of claim 1 wherein said first and second seats are adaptable to each adjustably retain a feeding tray.

5. The invention of claim 1, said retention mechanism further comprising a sliding mechanism attachable to said retaining mechanism for providing horizontal adjustability to each seat with respect to each other thereby providing reclining operation to said seats and said seat backs.

6. The intention of claim 5 wherein said child seats are adaptable to each adjustably retain a feeding tray.

7. The invention of claim 1, said pedestal further comprising five rollers for providing ground movement, each roller retained by five support members extending outward from the center of said pedestal and forming said pedestal retaining said telescoping column assembly.

8. The invention of claim 7, said pedestal further comprising a braking mechanism for preventing rolling movement of said pedestal.

9. The invention of claim 8, said pedestal further comprising a brake for at least one roller.

10. A support and retention device for supporting and retaining interchangeable furnishings or equipment, comprising:

a) a pedestal further comprising:

i) a plurality of support arms extending outwardly from the center of said pedestal, said center portion providing lateral support for the bottom of the horizontally adjustable support column;

ii) a plurality of wheels attached to said arms at outwardly extended locations on said arms, said wheels for providing ground mobility;

iii) a braking mechanism for selectively preventing ground mobility;

b) a vertically adjustable support column attached to said center portion of said pedestal, said vertically adjustable support column adapted for providing rotatable support to an equipment support and retention mechanism; and c) a support and retention mechanism adapted to selectively support and retain interchangeable furnishings; and a child seat assembly that is attachable to said equipment support and retention mechanism, wherein said child seat assembly comprises of two child seats adjustably assembled back-to-back for providing two child seating capacity with a singular unit.

11. The invention of claim 10 wherein said equipment support and retention mechanism further comprises at least one track having at least one locking mechanism, said track for interfacing with complimentary track members and retention assemblies of interchangeable furnishings and equipment.

12. A multi-purpose adjustable device for supporting and retaining interchangeable furnishings or equipment, comprising:

a pedestal comprising of five support members extending outward from the center of the pedestal wherein said pedestal supports a telescoping support column;

a telescoping support column attached to and projecting upwards from the pedestal and providing vertically adjustable and rotatable support for an equipment support and retention assembly;

a support and retention assembly supported by said telescoping support column for supporting and selectively retaining interchangeable furnishings, said assembly further comprising at least one track having at least one locking means, said at least one track for interfacing with complimentary track members and retention assemblies of interchangeable furnishings or equipment; and a child seat assembly that is attachable to said support and retention assembly about said at least one track, wherein said child seat assembly further comprises first and second child seats adjustably assembled back-to-back for providing two child seating capacity with a singular unit.

13. The invention of claim 12 further comprising:

said first and second child seats further comprise a respective first and second back support; and first and second carriage assemblies horizontally slidable on said at least one track, wherein said first and second carriages are each_assigned to a first and second seat of said child_seat assembly and allows each of said first and second seat to slide apart on said track to provide reclining to said first and second back support for each of said first and second seat, and for retaining each of said first and second seat to said track.

* * * * *